United States Patent [19]

Kido et al.

[11] Patent Number: 4,873,059

[45] Date of Patent: Oct. 10, 1989

[54] PIPETTE DEVICE

[75] Inventors: Keishiro Kido; Yoshio Saito, both of Saitama, Japan

[73] Assignee: Fuji Photo Film Co., Ltd., Kanagawa, Japan

[21] Appl. No.: 942,750

[22] Filed: Dec. 17, 1986

[30] Foreign Application Priority Data

Dec. 20, 1985 [JP] Japan ..... 60-286995

[51] Int. Cl.[4] ..... B01L 3/02

[52] U.S. Cl. ..... 422/100; 73/864.16; 73/864.24; 128/765; 604/207; 604/218

[58] Field of Search ..... 422/100; 128/765; 604/207, 208, 210, 218; 73/864.16, 864.18, 864.24

[56] References Cited

U.S. PATENT DOCUMENTS

| | | | |
|---|---|---|---|
| 4,056,360 | 11/1977 | Risch | 422/100 |
| 4,261,205 | 4/1981 | Oshikubo et al. | 422/100 |
| 4,263,257 | 4/1981 | Metsala | 422/100 |
| 4,475,905 | 10/1984 | Himmelstrup | 604/208 |
| 4,646,817 | 3/1987 | Hinchman et al. | 422/100 |

FOREIGN PATENT DOCUMENTS 151005 8/1985 European Pat. Off. .

*Primary Examiner*—Barry S. Richman
*Assistant Examiner*—Timothy M. McMahon
*Attorney, Agent, or Firm*—Sughrue, Mion, Zinn, Macpeak, and Seas

[57] ABSTRACT

A pipette device comprises a vertical housing, a cylinder member disposed at least in the lower section in the housing and urged upwardly so that the cylinder member is vertically slidable in the housing, a piston member urged upwardly and having a lower end portion vertically slidable in the cylinder member, and an engagement member for transmitting the downward movement of the piston member to the cylinder member. The engagement member engages the piston member with the cylinder member when the piston member moves down to an engagement position lower by a predetermined distance from the top position of the piston memer along the cylinder member, whereby the cylinder member is moved vertically together with the piston member against an upward urging force in the housing when the piston member is moved vertically between the engagement position and a position lower than the engagement position.

6 Claims, 1 Drawing Sheet

PIPETTE DEVICE

BACKGROUND OF THE INVENTION

1. Field of the Invention

This invention relates to a pipette device for spotting a sample solution, a reference solution or the like to a slide type ionic activity measuring device, a slide type dry colorimetric liquid analysis device, or the like.

2. Description of the Prior Art

Qualitative or quantitative analysis of a specific chemical constituent in a liquid sample is a general procedure conducted for a variety of industrial purposes. Quantitative analysis of chemical constituents or physical constituents in body fluids such as blood or urine is particularly important in biochemistry and clinical medicine.

In recent years, as disclosed in, for example, Japanese Patent Publication No. 53(1978)-21677 and Japanese Unexamined Patent Publication No. 55(1980)-164356, there has been developed and put into practice a slide type dry colorimetric liquid analysis device for quantitatively analyzing a specific chemical constituent or a specific physical constituent contained in a sample solution simply by spotting a droplet of the sample solution. In order to analyze a chemical constituent or the like contained in a sample solution by use of the slide type dry colorimetric liquid analysis device, a measured amount of the sample solution is applied to a chemical analysis slide and is incubated for a predetermined time in an incubator to cause a color reaction, and the reflection optical density is measured with a wavelength selected in advance in accordance with the combination of the constituent of the sample solution with a reagent contained in the reagent layer of the chemical analysis slide. In this manner, it is possible to achieve quantitative analysis of the chemical constituent or the like.

Also, as disclosed in, for example, Japanese Unexamined Patent Publication Nos. 58(1983)-211648 and 59(1984)-30055 and Japanese Patent Application No. 59(1984)-11744, there has been proposed an ionic activity measuring device for receiving an aqueous liquid sample, for example, wine, beverage, service water, or, a body fluid (blood, urine, saliva or the like), which is provided in droplets and quantitatively analyzing the activity or concentration of a predetermined ion contained in the sample by potentiometry.

In general, the ionic activity measuring device is provided with at least one pair of ion selective electrodes having as the outermost layer an ion selective layer which reflectively responds to a predetermined ion. The ion selective electrode pair is supported between an upper frame and a lower supporting frame. The upper frame is provided with a pair of liquid access holes positioned to correspond to the position of the ion selective electrode pair. A porous bridge (which is preferably constituted of twisted yarn) is disposed, usually on the upper frame, for achieving liquid junction and thus electrical conduction, between a sample solution put to one of the pair of the liquid access holes and a reference solution put to the other of the pair. In the case where multiple pairs of the ion selective electrodes are provided, pairs of porous liquid distributing members for communicating pairs of ion selective electrode pairs with pairs of the liquid access holes are disposed generally between the upper or the lower frame and the ion selective electrode pairs.

In the case where the ionic activity measuring device having the aforesaid configuration is provided with, for example, three pairs of ion selective electrodes responding respectively to $Na^+$, $K^+$, and $Cl^-$ ions, a reference solution having known activity values of these ions is spotted to one of the pair of the liquid access holes, and a sample solution wherein the activity values of these ions are unknown is spotted to the other of the pair of the liquid access holes (the reference solution and the sample solution should preferably be spotted substantially at the same time). The reference solution and the sample solution, on one hand, penetrate through the porous liquid distributing members to the corresponding ion selective electrodes. On the other hand, the reference solution and the sample solution penetrate through the porous bridge until they contact each other near the middle of the porous bridge to achieve liquid junction, and thus electrical conduction is effected between the two solutions. As a result, a potential difference proportional to the difference in a activity of each ion between the reference solution and the sample solution arises between the electrodes of each ion selective electrode pair. When the potential differences are measured, it is possible to measure the activity values of the $Na^+$, $K^+$ and $Cl^-$ ions contained in the sample solution simultaneously, sequentially or, when necessary, based on measured values and calibration curves determined in advance from the activity values of the ions in the standard solution (by use of the Nernst equation).

With the aforesaid ionic activity measuring device, it is possible to measure the ionic activity simply by spotting the sample solution and the reference solution only once. Therefore, the ionic activity measuring device is very advantageous for analysis of an aqueous liquid sample, particularly for clinical analysis of a sample such as of blood taken from the human body.

When chemical analysis using the aforesaid ionic activity measuring device, the slide type dry colorimetric liquid analysis device or the like is carried out, it is necessary to feed a predetermined amount of a sample solution, a reference solution or the like by spotting. As the spotting means for this purpose, a pipette device is used.

The pipette device comprises, for example, a vertical housing with a cylindrical portion formed at least at the lower part of the housing, a piston member slideably disposed in the housing and the lower end portion of which is urged upwardly, and a pipette tip fitting section arranged at the lower end of the housing so that the pipette tip fitting section communicates with the cylindrical portion. In order to feed a sample solution, a reference solution or the like with the pipette device, a pipette tip is fitted to the tip fitting section, the tip is dipped into the solution, and the piston member is moved up in the cylindrical portion to draw the sample solution or the like into the pipette tip. Then, the lower end of the pipette tip is moved into position over the slide etc. for spotting, and the piston member is pushed down by a finger or the like to spot the sample solution or the like onto the slide etc.

In this case, the sample solution or the like spotted onto the slide etc. is not immediately absorbed thereinto, and remains for some time in spherical droplet form thereon. However, in many cases, spotting is conducted by positioning the lower end of the pipette tip close to the slide for accurately spotting the sample solution or the like at a predetermined position on the slide. Therefore, the lower end of the pipette tip often may contact the sample solution spotted in the spherical droplet form, and if the piston member is then released and thereby moved upward by the urging force, the sample solution or the like spotted to the slide is drawn back into the pipette tip.

Therefore, in order to feed a sample solution or the like by use of the aforesaid pipette device, it is necessary to keep the piston member pushed down, move the pipette device up to separate the lower end of the pipette tip from the spotted liquid on the slide, and then release the piston member. However, the piston member is often pulled up by error before taking up the pipette device away, causing drawing back of the liquid into the pipette tip.

SUMMARY OF THE INVENTION

The primary object of the present invention is to provide a pipette device free from drawing back of liquid into a pipette tip even when a piston member is pulled up from the lowest position after the liquid has been put onto a slide or the like.

Another object of the present invention is to provide a pipette device suitable for accurately spotting a sample solution or the like by a simple operation.

The present invention provides a pipette device comprising:

(i) a vertical housing, (ii) a cylinder member disposed at least at the lower section in said housing so as to be vertically slidable in said housing and extending vertically past the lower end of the housing;

(iii) means for upwardly biasing the cylinder member;

(iv) a piston member urged upwardly and having a lower end portion vertically slidable in said cylinder member, (v) means for upwardly biasing the piston member, and (vi) an engagement member for transmitting the downward movement of said piston member to said cylinder member, wherein said engagement member engages said piston member with said cylinder member when said piston member moves down to an engagement position lower by a predetermined distance than a top position within the movement range of said piston member in said cylinder member, whereby said cylinder member is moved vertically together with said piston member against an upward urging force in said housing while said piston member is moved vertically between said engagement position and a position lower than said engagement position.

With the pipette device of this invention, while the piston member is pulled up due to the urging after ejection of liquid from the pipette is finished, the cylinder member is lifted together with the piston member within a predetermined range, whereby the pipette tip is kept away from the liquid droplet put on the slide or the like. Therefore, even though the piston member is thereafter moved up, there can be no drawing back of liquid from the droplet already put on the slide into the pipette tip again.

BRIEF DESCRIPTION OF THE DRAWINGS

FIG. 1 shows the state where the piston member is placed at the uppermost position, FIG. 2 shows the state where it is in the engagement position, FIG. 3 shows the state where the piston member is at the the lowest position.

DESCRIPTION OF THE PREFERRED EMBODIMENTS

The present invention will hereinbelow be described in further detail with reference to the accompanying drawings.

Figure 1:
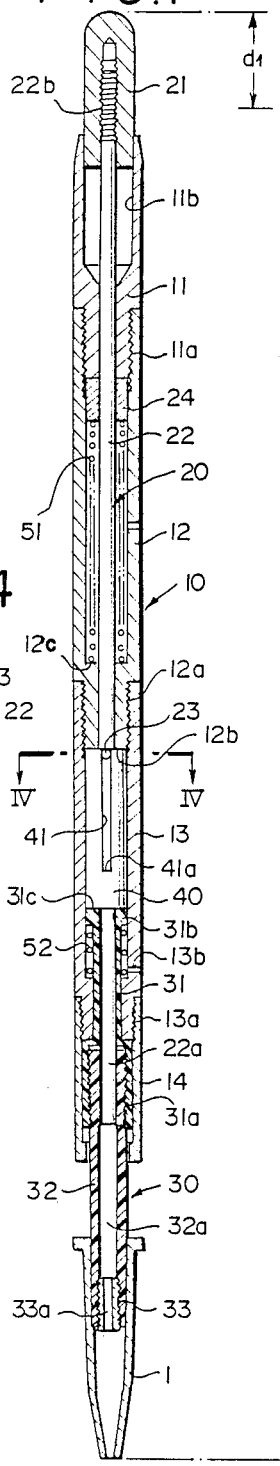
FIGS. 1, 2 and 3 are sectional views respectively showing the conditions of an embodiment of the pipette device in accordance with the present invention.
Figure 2:
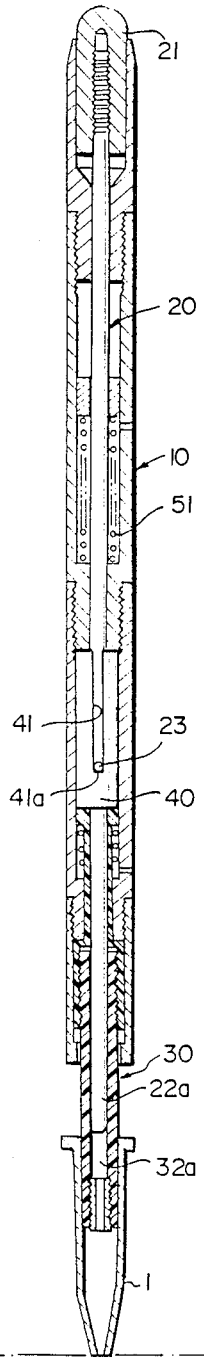
Figure 3:
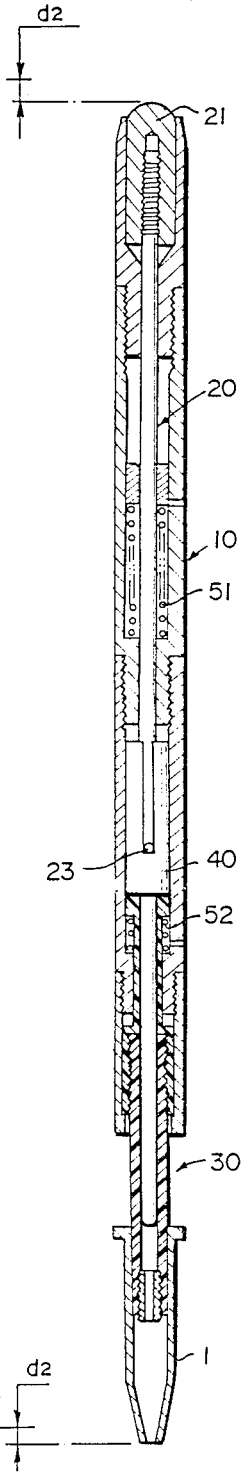

Referring to FIGS. 1, 2 and 3, an embodiment of the pipette device in accordance with the present invention comprises a cylindrical housing 10 extending vertically, a cylinder 30 disposed at the lower end portion of the housing 10 vertically slidable in the housing 10, and a piston member 20 of which a lower end portion is vertically slidable in the cylinder 30, and the upper portion is slidably disposed in the housing 10, the upper end being projected upwardly from the upper end of the housing 10. The housing 10 is constituted by an upper housing 11 disposed at the upper end section, a first intermediate sleeve 12 joined by threads **11*a* with the lower section of the upper housing 11, a second intermediate sleeve 13 joined by threads 12*a* with the lower section of the first intermediate sleeve 12, and a lower sleeve 14 joined by threads 13*a* with the lower section of the second intermediate sleeve 13. The piston member 20 is constituted by a knob 21 which is vertically slidable in an upper sliding hole 11*b* disposed in the upper housing 11 and which opens upwardly. The top portion of knob 21 projects upwardly from the upper housing 11. A piston rod 22 is disposed vertically in the housing 10 and is slidable therein. The piston rod 22 has an upper end portion in engagement by threads 22*b* with the knob 21. The cylinder 30 is constituted by a guide member 31 having an upper portion 31*e* vertically slideably guided in the second intermediate sleeve 13 and a lower portion 31*d* vertically slideably guided in the lower sleeve 14, a cylinder body 32 joined by threads 32*c* to a correspondingly threaded portion 31*a* of the interior surface of a lower portion of the guide member 31 and having a cylinder chamber 32*a* into which the lower end of the piston rod 22 is inserted, and a nozzle member 33 having a nozzle hole 33*a* in engagement with the lower end of the cylinder body 32**.

The cylinder 30 is urged upwardly by a lower spring 52 disposed between a flange section **31*b* of the guide member 31 and inner surface 13*b* of the second intermediate sleeve 13. Also, an engagement member 40 located between an upper end surface 31*c* of the flange 31*b* of guide member 31 and a lower end surface 12*b* of the first intermediate sleeve 12 and vertically slidable in the second intermediate sleeve 12 is disposed above the cylinder 30. Therefore, when the guide member 31 is moved up by the urging force of the lower spring 52, the engagement member 40 is also moved up. The urging force of the lower spring 52 is received by the first intermediate sleeve 12 contacting the engagement member 40**.

On the other hand, a guide flange 24 secured to the piston rod 22 is vertically slidable in the bore of the first intermediate sleeve 12. The piston member 20 is urged upwardly by an upper spring 51 disposed between the guide flange 24 and a bore bottom surface **12*c* of the first intermediate sleeve 12. Therefore, normally, the piston member 20 is maintained at an upper position where the guide flange 24 is in contact with the lower end surface of the upper housing 11**.

Figure 4:
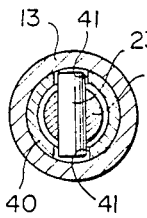
FIG. 4 is a sectional view taken along line IV—IV of FIG. 1.

The piston rod 22 extends through the engagement member 40, and a pin 23 is secured to the piston rod 22 in the radius direction of the piston rod 22 at the position where the piston rod 22 extends through the engagement member 40. The pin 23 engages with guide slot 41 formed to vertically extend through the engagement member 40. As shown in detail in FIG. 4, the cylindrical engagement member 40 disposed vertically slideably in the second intermediate sleeve 13 is provided with the vertically extending guide slots 41 spaced by 180° from each other. The pin 23 is secured to the piston rod 22 in the radius direction of the piston rod 22. The ends of the pin 23 projecting from the piston rod 22 are loosely engaged with the guide slots 41. The pin 23 is positioned at the upper end sections of the guide slots 41 when the piston rod 22 is at the upper position (i.e. the position shown in FIG. 1), and can move down in the guide slots 41 when the piston rod 22 is moved down.

When feeding of a sample solution or the like is to be conducted, the pipette device is operated as described below.

First, a pipette tip 1 is fitted to the lower end of the cylinder 30.

The term "pipette tip" as used herein means a tip member provided with a hole for dropping a sample solution or a reference solution in an amount (normally several tens of microliters) suitable for, for example, measurement of ionic activity conducted by using the slide type ionic activity measuring device. The pipette tip preferably have a shape adapted to releasable fitting to the lower end of the cylinder 30. Through a liquid can be put directly into the cylinder chamber 32*a* without using the pipette tip, the use of a pipette tip which is adapted to releasably fit to the connection member is preferable, since a liquid reservoir for drawing and holding a liquid therein should be preferably renewed for each operation of liquid feeding.

After the knob 21 is pressed down to the lowest position, the lower end of the pipette tip 1 is dipped into a sample solution, a reference solution or the like, and the knob 21 is released to allow the piston member 20 to return up to the upper position by the urging force of the upper spring 51. With the vertical movement of the piston member 20, the lower end of the piston rod 22 is moved up in the cylinder chamber 32*a* to draw a predetermined amount of the sample solution, a reference solution or the like into the pipette tip 1. Thereafter, in order to put the liquid from the pipette tip 1 onto a slide or the like, the lower end of the pipette tip 1 is placed above a predetermined position of the slide, and the knob 21 is pushed down. When the knob 21 is pushed down by a distance d1, the piston member 20 is moved down from the upper position shown in FIG. 1 to the engagement position shown in FIG. 2. Since the pin 23 is moveable along the guide slots 41 of the engagement member 40, the engagement member 40 and the cylinder 30 are maintained at their upper positions by the lower spring 52 when the piston member 20 is thus moved. Therefore, the piston member 20 only is moved down, the lower end of the piston rod 22 is inserted into the cylinder chamber 32*a*, and the liquid in the pipette tip 1 is put therefrom onto the slide. At the engagement position, the pin 23 moved down along the slots 41 contacts lower surfaces 41*a* of the slots 41. Therefore, as shown in FIG. 3, when the knob 21 is further pressed down by a distance d2 from the engagement position, the piston member 20 is moved down to its lower position, and the engagement member 40 and the cylinder 30 are moved down together with the piston member 20 by the distance d2 against the urging force of the lower spring 52 since the pin 23 is in contact with the lower surfaces, 41*a* of the slots, 41. In this manner, the knob 21 is pressed down to move the piston member 20 from the uppermost position shown in FIG. 1 to the lowest position shown in FIG. 3 and the liquid is fed from the pipette tip 1 onto the slide. In this condition, the lower end of the pipette tip 1 often comes into contact with the spherical droplet of the liquid formed on the slide. The case where the knob 21 is released when the lower end of the pipette tip is in contact with the liquid drop shall now be described hereinbelow.

When the knob 21 is relieved from pressure, the piston member 20, the cylinder 30 and the engagement member 40 are moved back, the state changes from that of FIG. 3 to that of FIG. 2, and then returns to the state shown in FIG. 1 due to the urging force of the upper spring 51 and the lower spring 52. As the state changes from that in FIG. 3 to that in FIG. 2, the piston member 20 and the cylinder 30 are lifted together by the distance d2, and the lower end of the pipette tip 1 as well are lifted. As long as the piston member 20 and the cylinder 30 lift up together, there is no relative movement between them. Therefore, the lower end of the pipette tip 1 can be separated from the liquid drop without drawing back of the liquid into the pipette tip. Even though the piston member 20 is pulled towards the uppermost position, as shown in FIG. 1, due to the urging force of the spring 51, drawing back of the liquid into the pipette tip 1 does not occur, since the lower end of the pipette tip 1 is already separated from the liquid drop.

We claim:

1. A pipette device comprising:

(i) a vertical housing, (ii) a cylinder member having a pipette tip fitting section at the lower end thereof to which a removalable pipette tip is fitted, for receiving and issuing liquid, disposed at least at a lower section of said housing so as to be vertically slidable in said housing and extending vertically past a lower end of said housing;

(iii) means for upwardly biasing said cylinder member, (iv) a piston member having a lower end portion vertically slidable in said cylinder member, (v) means for upwardly biasing said piston member, and (vi) an engagement member for engaging said piston member with said cylinder member, wherein said engagement member engages said piston member with said cylinder member when said piston member moves down to an engagement position, lower by a predetermined distance than a top position within the movement range of said piston member in said cylinder member, and wherein thereafter said cylinder member is moved vertically together with said piston member against a combined upward bias of said means for biasing said cylinder member and said means for biasing said piston member, in said housing while said piston member is moved vertically between said engagement position and a position lower than said engagement position.

2. A pipette device as defined in claim 1 wherein said housing comprises an upper housing, a first intermediate sleeve joined by threads with a lower section of said upper housing, a second intermediate sleeve joined by threads with a lower section of said first intermediate sleeve, and a lower sleeve joined by threads with the lower section of said second intermediate sleeve.

3. A pipette device as defined in claim 2 wherein said piston member comprises a knob vertically slidable in an upper sliding hole of said upper housing and projected out and away from said upper housing, and a piston rod disposed vertically slidably in said housing and having an upper end portion extending vertically in engagement by threads with said knob.

4. A pipette device as defined in claim 3 wherein said cylinder member comprises a guide member having an upper portion vertically slidably guided in said second intermediate sleeve and a lower portion vertically slidably guided in said lower sleeve, a cylinder body joined by threads with said guide member and having a cylinder chamber into which the lower end of said piston rod is inserted, and a nozzle member having a nozzle hole in engagement with a lower end of said cylinder body.

5. A pipette device as defined in claim 3 wherein said engagement member is sandwiched between an upper end surface of said cylinder and a lower end surface of said first intermediate sleeve, and is vertically slidable in said second intermediate sleeve.

6. A pipette device as defined in claim 5 wherein said piston rod extends through said engagement member, and a pin is secured to said piston rod at the position where said piston rod extends through said engagement member so that said pin engages with guide slots formed to vertically extend through said engagement member and contacts lower surfaces of said guide slots when said piston member is moved down to said engagement position.

* * * * *